US007296322B2

(12) United States Patent
Park

(10) Patent No.: US 7,296,322 B2
(45) Date of Patent: Nov. 20, 2007

(54) HOSE ASSEMBLY FOR A CLEANER AND UPRIGHT-TYPE VACUUM CLEANER USING THE SAME

(75) Inventor: Jung-seon Park, Gwangju (KR)

(73) Assignee: Samsung Gwangju Electronisc Co., Ltd., Gwangju (KR)

( * ) Notice: Subject to any disclaimer, the term of this patent is extended or adjusted under 35 U.S.C. 154(b) by 745 days.

(21) Appl. No.: 10/761,074

(22) Filed: Jan. 20, 2004

(65) Prior Publication Data

US 2005/0081322 A1 Apr. 21, 2005

(30) Foreign Application Priority Data

Oct. 16, 2003 (KR) ..... 10-2003-0072026

(51) Int. Cl.
*A47L 9/32* (2006.01)

(52) U.S. Cl. ..... 15/328; 15/331; 15/334; 15/351; 15/410; 15/414

(58) Field of Classification Search ..... None
See application file for complete search history.

(56) References Cited

U.S. PATENT DOCUMENTS 5,747,764 A * 5/1998 Son et al. ..... 200/61.96
5,815,883 A * 10/1998 Stein et al. ..... 15/327.1
5,850,666 A * 12/1998 Farone et al. ..... 15/339
2003/0101535 A1 6/2003 Gammack et al.
2006/0174441 A1* 8/2006 Genoa et al. ..... 15/410

FOREIGN PATENT DOCUMENTS

GB 2396895 7/2004
GB 2396896 7/2004
KR 20030066898 8/2003

* cited by examiner

*Primary Examiner*—David Redding
(74) *Attorney, Agent, or Firm*—Ladas & Parry LLP

(57) ABSTRACT

A hose connection assembly for a vacuum cleaner comprises a flexible hose having one end connected to the dust-collecting chamber, a hose holder connected to the other end of the flexible hose and removably connected to a connection part of the suction brush, and a handle mounted on the hose holder to assist in connecting and disconnecting the hose holder with respect to the connection part. A mounting portion having a circumferential bead is preferably formed on an outer circumference of the hose holder to mount the handle therein, and the handle is rotatably mounted on the mounting portion. The handle comprises a fixing portion shaped as a cylinder and is mounted on the mounting portion, and a holding portion protruding from one side of the fixing portion in a perpendicular direction, and the fixing portion has a larger diameter than the mounting portion, thereby providing rotatability about the mounting portion through 360°.

14 Claims, 6 Drawing Sheets

HOSE ASSEMBLY FOR A CLEANER AND UPRIGHT-TYPE VACUUM CLEANER USING THE SAME

BACKGROUND OF THE INVENTION

1. Field of the Invention

The present invention relates generally to a cleaner, and more particularly, to a hose assembly, which connects a dust-collecting chamber of a cleaner body to a suction brush and also serves as an auxiliary brush to clean a narrow area, especially having a handle enabling easy connection and disconnection of the hose assembly, and an upright-type vacuum cleaner having the same.

2. Description of the Background Art

As shown in FIG. 1, an upright-type vacuum cleaner generally includes a cleaner body 10, a suction brush 20 disposed at a lower portion of the cleaner body 10, and a hose assembly 30 forming a suction flow channel connecting a dust-collecting chamber (not shown), disposed within the cleaner body, to the suction brush 20.

A driving chamber (not shown) disposed under the dust-collecting chamber of the cleaner body 10 houses therein a vacuum-generating device, and the dust-collecting chamber houses dirt-filtering means such as a paper filter.

As the vacuum-generating device is driven, there occurs a negative pressure in the dust-collecting chamber. Accordingly, air having entrained dirt is drawn into the dust-collecting chamber from a cleaning surface through the suction brush 20 and the hose assembly 30. While the air is discharged out after passing through the dirt-filtering means and the driving chamber, the dust and dirt are filtered and collected by the dirt-filtering means.

Meanwhile, in addition to the function of connecting the dust-collecting chamber of the cleaner body 10 to the suction brush 20, the hose assembly 30 is also used as an auxiliary brush to clean narrow areas, which are hard to reach by the suction brush 20.

In order to be used as the auxiliary brush, the hose assembly 30 includes a flexible hose 31 having one end connected to the dust-collecting chamber of the cleaner body 10, and a hose holder 32 connected to the other end of the flexible hose 31. The hose holder 32 is removably connected to a connection part 21 disposed adjacent the suction brush 20.

That is, to use the hose holder 32 of the hose assembly 30, it is separated from the connection part 21 in order to clean in a narrow area, and after the narrow area has been cleaned, the hose holder 32 is re-connected to the connection part 21 in order for the suction brush 20 to clean a large area.

However, in a conventional upright type vacuum cleaner as described above, the hose assembly 30 is positioned on a rear portion of the cleaner body 10 and there are many parts surrounding the hose assembly 30. Therefore, it is difficult and inconvenient to connect and disconnect the hose holder 32 of the hose assembly 30 with respect to the connection part 21.

SUMMARY OF THE INVENTION

The present invention has been developed in order to solve the problems mentioned above. Accordingly, it is an aspect of the present invention to provide a hose connection assembly for a vacuum cleaner having a handle enabling easy connection and disconnection of the hose connection assembly, and an upright type vacuum cleaner having the same.

The above aspect is achieved by providing a hose connection assembly for a vacuum cleaner, which is disposed between a dust-collecting chamber of a cleaner body and a connection part of a suction brush, the hose connection assembly comprising a flexible hose having one end connected to the dust-collecting chamber, a hose holder connected to the other end of the flexible hose and being removably connected to the connection part of the suction brush, and a handle mounted on the hose holder to assist in connecting and disconnecting the hose holder with respect to the connection part.

A mounting portion having a bead, preferably a circumferential bead, is formed on an outer circumference of the hose holder to mount the handle therein, and the handle is rotatably mounted on the mounting portion.

The handle comprises a fixing portion shaped as a cylinder and is mounted on the mounting portion, with a holding portion protruding from one side of the fixing portion in a perpendicular direction, and the fixing portion has a larger diameter than that of the mounting portion, thereby providing the ability to rotate about the mounting portion through 360°.

The bead has a diameter difference relative to the cylindrical surface of the mounting portion that is larger than a gap formed by the diameter difference between the mounting portion and the fixing portion.

Also, one circumferential bead may be formed along an outer circumference of the mounting portion in an annular pattern, and a plurality of circumferential beads may be formed along an outer circumference of the mounting portion at predetermined intervals from each other.

The holding portion is provided with a protrusion to prevent slipping when a user holds the holding portion, and in this case, it is preferred that the protrusion is formed on a lower surface of the holding portion.

Meanwhile, the above aspect is also achieved by providing an upright type vacuum cleaner comprising a cleaner body having a dust-collecting chamber and a driving chamber, each being divided by a partition, a suction brush disposed below the cleaner body and having a connection part to form a flow channel to the dust-collecting chamber; and a hose connection assembly interposed between the dust-collecting chamber and the connection part. The hose connection assembly comprises a flexible hose having one end connected to the dust-collecting chamber, a hose holder connected to the other end of the flexible hose and separately connected to the connection part, and a handle mounted on the hose holder to assist in connecting and disconnecting the hose holder with respect to the connecting portion.

BRIEF DESCRIPTION OF THE DRAWING FIGURES

The above aspect and other advantages of the present invention will be more apparent by describing an exemplary embodiment of the present invention with reference to the accompanying drawings, in which.

DESCRIPTION OF THE PREFERRED EMBODIMENT

Figure 1:
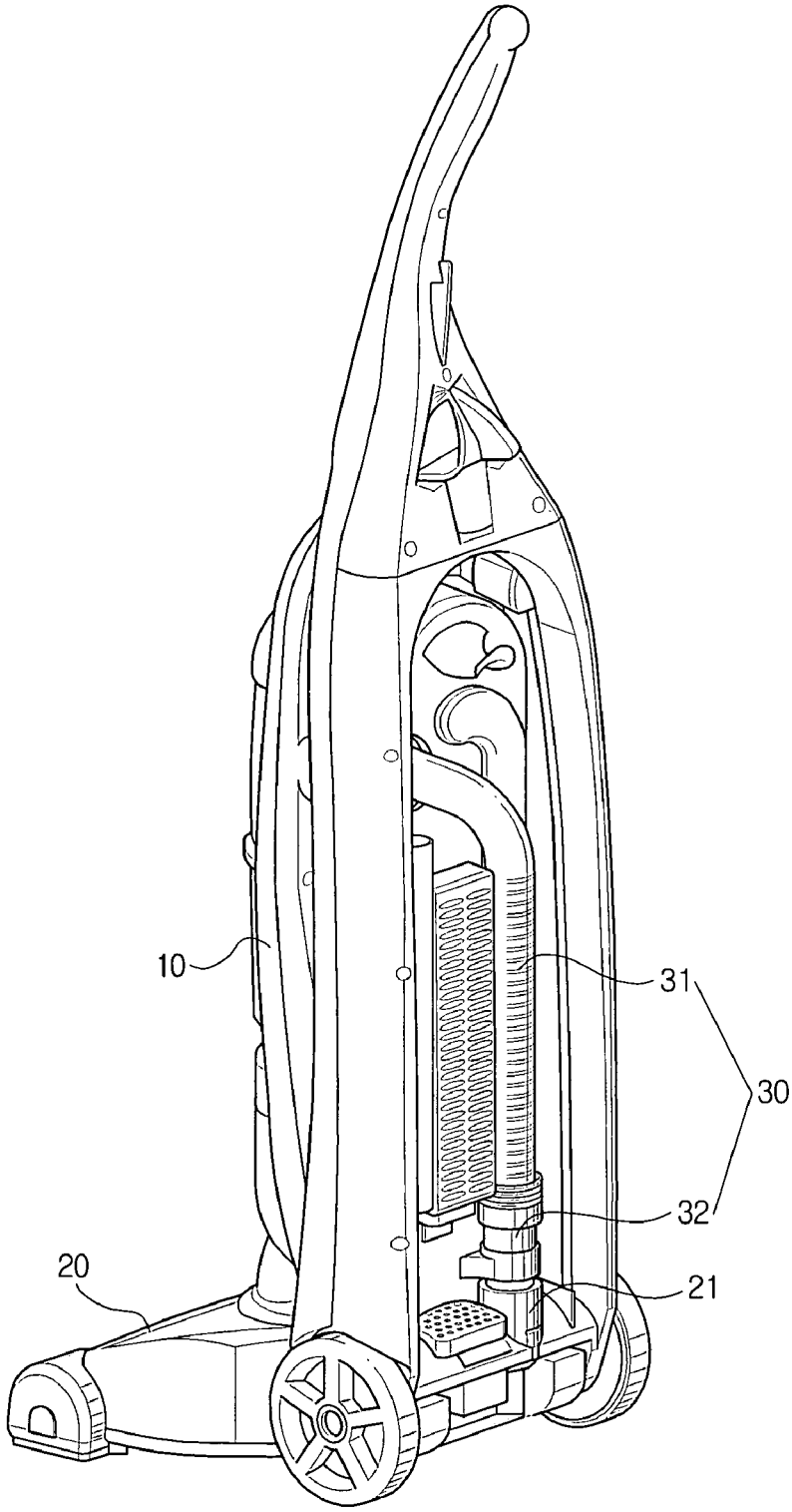
FIG. 1 (PRIOR ART)
FIG. 1 is a perspective view showing a general conventional upright type vacuum cleaner having a hose assembly.
Figure 2:
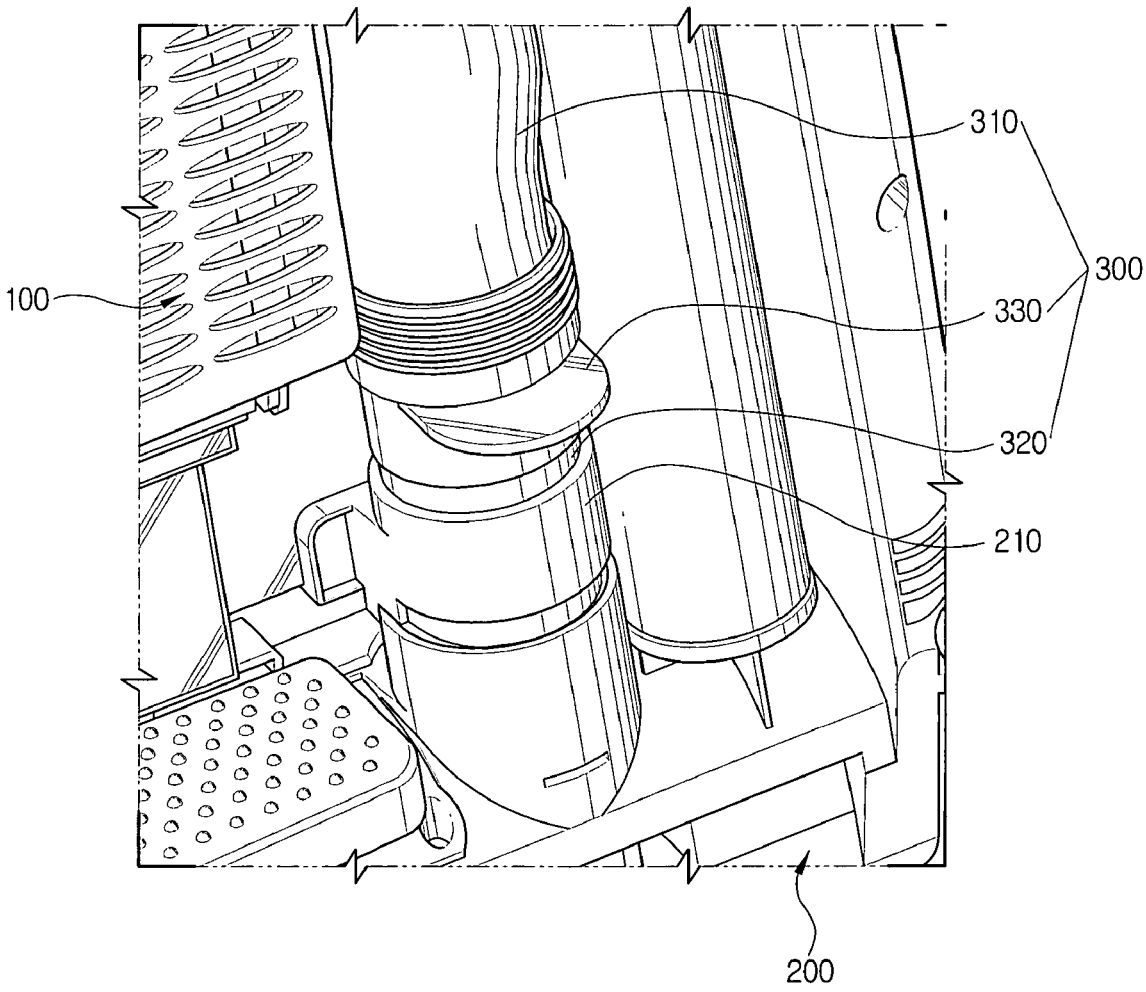
FIG. 2 is a perspective detail view showing the main parts of an upright type vacuum cleaner having a hose connection assembly according to the present invention.
Figure 3:
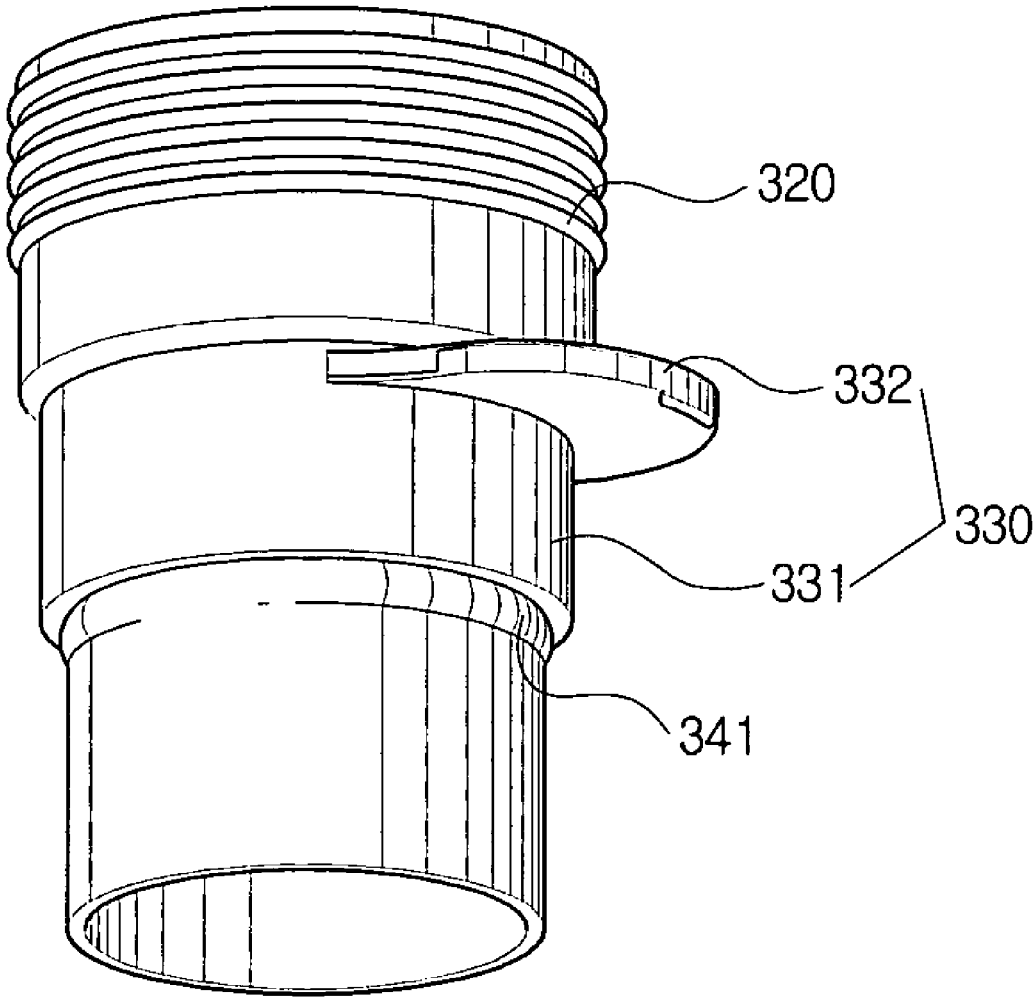
FIG. 3 is a perspective view of the hose connection assembly of the vacuum cleaner of FIG. 2.

Referring to FIGS. 2 and 3, an upright type vacuum cleaner according to the present invention includes a cleaner body 100, a suction brush 200, and a hose connection assembly 300, similar to that of the conventional vacuum cleaner shown in FIG. 1.

Albeit not shown in FIG. 2 or 3, the cleaner body 100 has a dust-collecting chamber and a driving chamber formed therein, which are divided by a partition. The dust-collecting chamber is provided with dirt-filtering means such as a paper filter, and the driving chamber is provided with a vacuum-generating device.

The suction brush 200 is disposed below the cleaner body 100, and has a connection part 210 formed at one side thereof to be connected to the hose connection assembly 300 and thereby form a suction flow channel.

The hose connection assembly 300 connects the connection part 210 of the suction brush 200 to the dust-collecting chamber of the cleaner body 100, thereby forming the suction flow channel connecting the suction brush to the dust-collecting chamber of the cleaner body 100. Also, the hose connection assembly 300 may be used as an auxiliary brush to clean in a narrow area, such as a corner or a window frame, which is hard to reach by the suction brush 200.

The hose connection assembly 300 includes a flexible hose 310, a hose holder 320, and a handle 330.

The flexible hose 310 has one end connected to the dust-collecting chamber of the cleaner body 100 and the other end connected to the hose holder 320. The hose holder 320 is removably connected to the connection part 210 of the suction brush 200. That is, the hose holder 320 is connected to the connection part 210 in order to clean a surface when using the suction brush 200, and is separated from the connection part 210 when it is to be used as the auxiliary brush.

Meanwhile, the handle 330, which is one of the main features of the present invention, is disposed on the hose holder 320 to assist in connecting or disconnecting the hose holder 320 with respect to the connection part 210.

Figure 4:
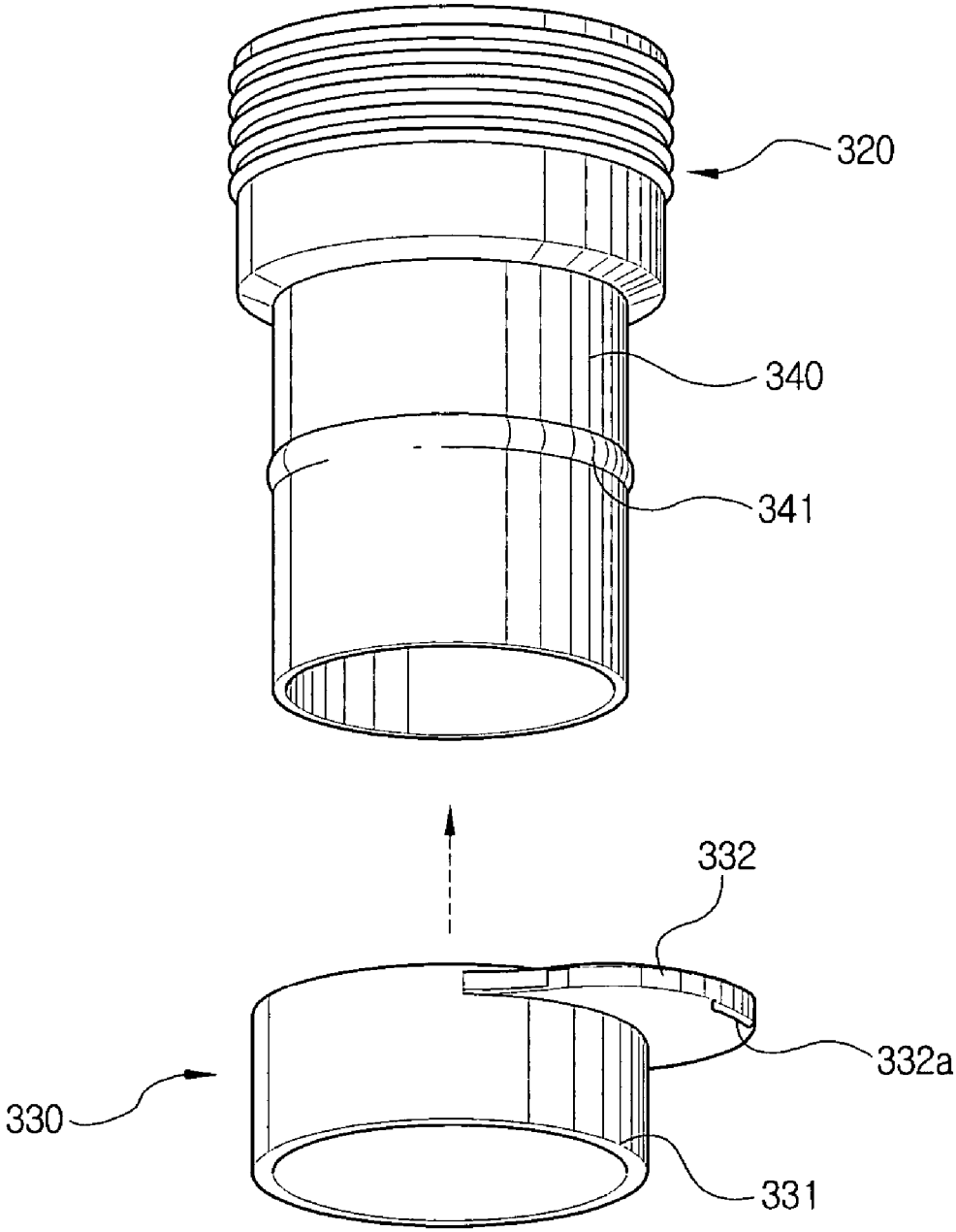
FIG. 4 is an exploded perspective view of the hose connection assembly shown in FIG. 3.
Figure 5:
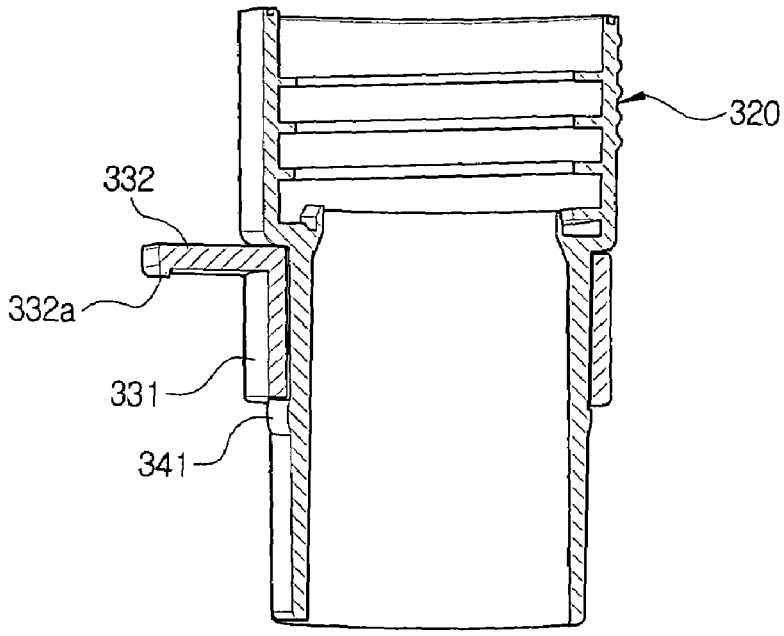
FIG. 5 is a cross section view of the hose connection assembly shown in FIG. 3.
Figure 6:
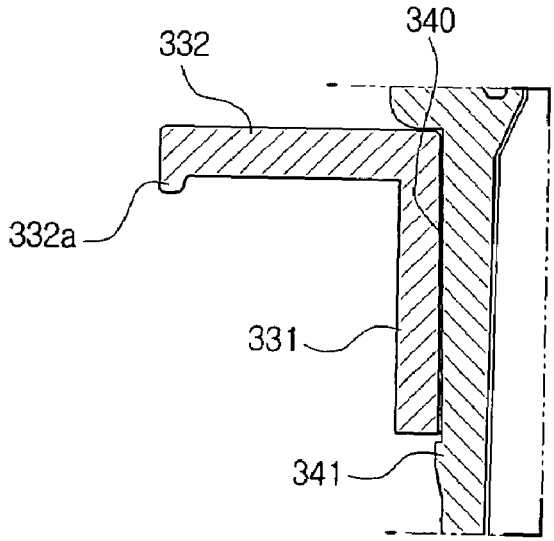
FIG. 6 is a detailed view of the connection between the elements shown in FIG. 5.

As shown in FIGS. 4 to 6, the hose holder 320 is provided with a mounting portion 340 having a circumferential bead 341 formed along an outer circumference of the hose holder 320, for mounting the handle 330 therein, and the handle 330 is rotatably mounted on the mounting portion 340.

The handle 330 includes a fixing portion 331 shaped as a hollow cylinder, mounted on the mounting portion 340, and a holding portion 332, protruding from one side of the fixing portion 331 in a perpendicular direction. Preferably, the fixing portion 331 has a diameter larger than that of the mounting portion 340 to permit rotation completely about the mounting portion 340 through 360°.

Also, the circumferential bead 341 has a diameter difference to the cylindrical surface of the mounting portion that is larger than a predetermined gap formed by the diameter difference between the mounting portion 340 and the fixing portion 331. Due to the presence of the circumferential bead 341, the handle 330 rotatably mounted on the mounting portion 340 can be prevented from deviating from the mounting portion 340.

In this embodiment, one circumferential bead 341 is formed along the outer circumference of the mounting portion 340 in an annular pattern. However, this should not be considered as limiting. A plurality of circumferential bead sections 341' may be formed along the outer circumference of the mounting portion at predetermined intervals from each other, as described below.

Also, the holding portion 332 is provided with a protrusion 332*a* provided for preventing slipping of a user's hold when a user holds the holding portion 332.

Figure 3A:
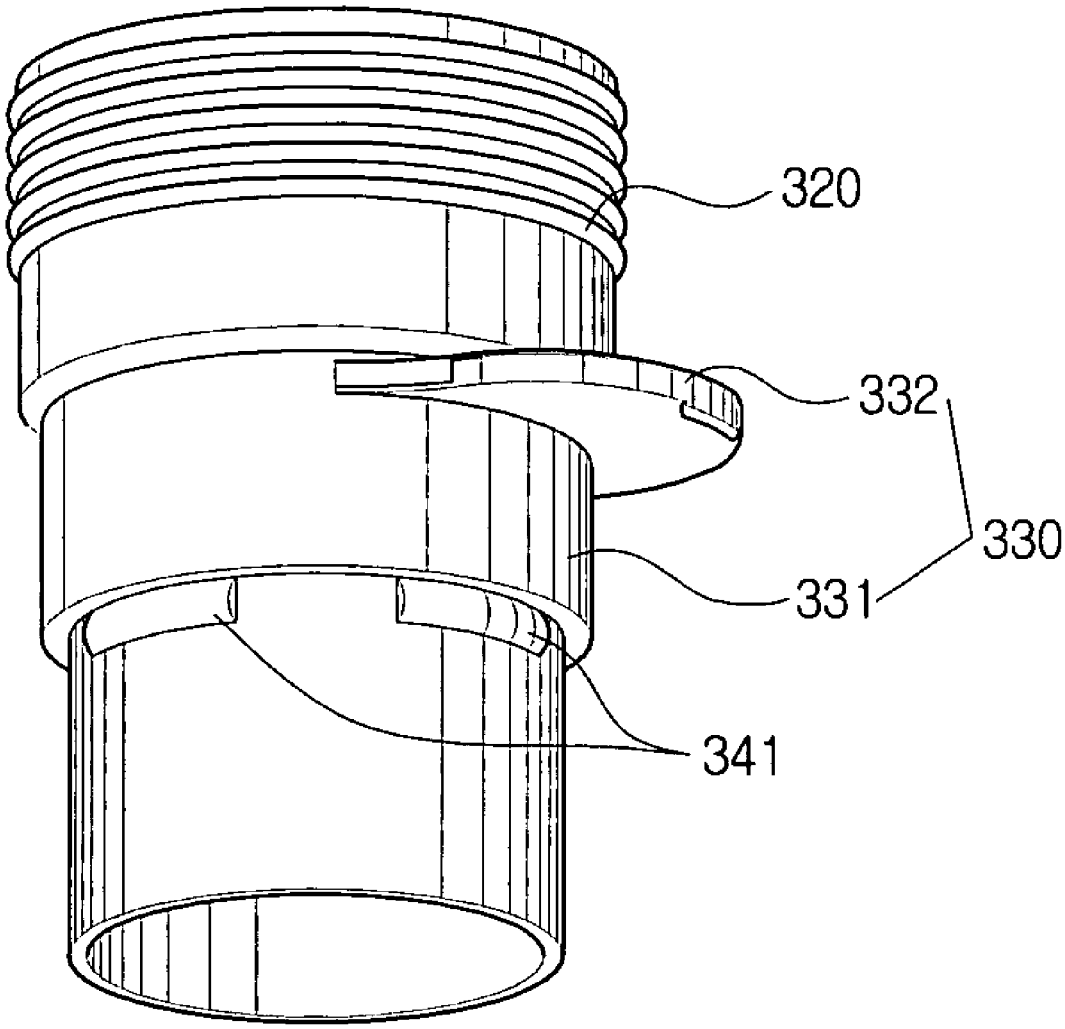
FIG. 3A is a perspective view of an alternative embodiment of the hose connection assembly of the vacuum cleaner.

FIG. 3A is a perspective view of an alternative embodiment of hose connection assembly of the vacuum cleaner, which in most respects is similar to that of the hose connection assembly 300 shown in FIG. 3, with the exception of the circumferential bead 341 that circumscribes the mounting portion 340. Whereas in FIG. 3 the circumferential bead 341 is a continuous band, in FIG. 3A, mounting portion 340' includes a plurality of circumferential bead sections 341' which are disposed in a circumferential pattern at discrete intervals from each other, with gaps between adjacent ones of the circumferential bead sections 341', as shown. Also as shown in FIG. 3A, the handle 330 of hose connection assembly 300 remains identical to that of the embodiment shown in FIG. 3, and thus the identifying numerals are identical.

The upright-type vacuum cleaner having the hose connection assembly 300 with the above construction performs a cleaning operation for a relatively large area using the suction brush 200 with the hose holder 320 of the hose connection assembly 300 being connected to the connection part 210 of the suction brush 200.

Meanwhile, in order to clean a narrow area that is hard to reach by the suction brush 200, the hose holder 320 is separated from the connection part 210 so that the hose connection assembly 300 may be used as the auxiliary brush.

At this time, due to the presence of the handle 330 of the hose holder 320, it is easy for a user to connect the hose holder 320 to the connection part 210 or disconnect the hose holder 320 from the connection part 210 by holding the handle 330 with his/her hands. Also, since the handle 300 completely rotates about the hose holder 320 through 360°, a user can hold the handle 300 from any direction to connect and disconnect the hose connection assembly 300.

According to the present invention as described above, providing the handle 330 in the hose holder 320 of the hose connection assembly 300 allows a user to hold it with his/her hand so that the user easily separates the hose connection assembly 300 from or connects it to the connection part 210 of the suction brush 200. Accordingly, the convenience to the user in using the cleaner is improved.

The foregoing embodiment and advantages are merely exemplary and are not to be construed as limiting the present invention. The description of the present invention is intended to be illustrative, and not to limit the scope of the following claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A hose connection assembly for a vacuum cleaner, which is disposed between a dust-collecting chamber of a cleaner body and a connection part of a suction brush, the hose connection assembly comprising:

a flexible hose having one end connected to the dust-collecting chamber;

a hose holder connected to the other end of the flexible hose and being removably connected to the connection part of the suction brush; and a handle mounted on the hose holder to assist in connecting and disconnecting the hose holder with respect to the connection part, the handle being comprised of a fixing portion shaped as a cylinder and mounted on a mounting portion, and a holding portion protruding from one side of the fixing portion in a perpendicular direction, the fixing portion having a larger diameter than that of the mounting portion, thereby being rotatable about the mounting portion through 360°.

2. The hose connection assembly for the vacuum cleaner of claim 1, wherein the mounting portion having a bead is formed on an outer circumference of the hose holder to mount the handle thereon, and the handle is rotatably mounted on the mounting portion.

3. The hose connection assembly for the vacuum cleaner of claim 2, wherein the bead has a diameter difference relative to the cylindrical surface of the mounting portion that is larger than a gap formed by the diameter difference between the mounting portion and the fixing portion.

4. The hose connection assembly for the vacuum cleaner of claim 3, wherein one circumferential bead is formed along an outer circumference of the mounting portion in an annular pattern.

5. The hose connection assembly for the vacuum cleaner of claim 3, wherein a plurality of circumferential beads are formed along an outer circumference of the mounting portion at predetermined intervals from each other.

6. The hose connection assembly for the vacuum cleaner of claim 2, wherein the holding portion is provided with a protrusion to prevent slipping when a user holds the holding portion.

7. An upright type vacuum cleaner comprising:

a cleaner body having a dust-collecting chamber and a driving chamber, each being divided by a partition;

a suction brush disposed below the cleaner body and having a connection part to form a flow channel to the dust-collecting chamber; and a hose connection assembly interposed between the dust-collecting chamber and the connection part, the hose connection assembly comprising, a flexible hose having one end connected to the dust-collecting chamber, a hose holder connected to the other end of the flexible hose and removably connected to the connection part, and a handle mounted on the hose holder to assist in connecting and disconnecting the hose holder with respect to the connecting portion, the handle comprised of a fixing portion shaped as a cylinder and mounted on a mounting portion, and a holding portion protruding from one side of the fixing portion in a perpendicular direction, the fixing portion having a larger diameter than that of the mounting portion, thereby being rotatable about the mounting portion by 360°.

8. The upright type vacuum cleaner of claim 7, wherein the mounting portion having a circumferential bead is formed on an outer circumference of the hose holder to mount the handle therein, and the handle is rotatably mounted on the mounting portion.

9. The upright type vacuum cleaner of claim 8, wherein the circumferential bead has a diameter difference relative to the cylindrical surface of the mounting portion that is larger than a gap formed by the diameter difference between the mounting portion and the fixing portion.

10. The upright type vacuum cleaner of 9, wherein one circumferential bead is formed along an outer circumference of the mounting portion in an annular pattern.

11. The upright type vacuum cleaner of claim 8, wherein a plurality of circumferential beads are formed along an outer circumference of the mounting portion at predetermined intervals from each other.

12. The upright type vacuum cleaner of claim 8, wherein the holding portion is provided with a protrusion to prevent slipping when a user holds the holding portion.

13. The hose connection assembly for the vacuum cleaner of claim 2, wherein the mounting portion has a circumferential bead formed on an outer circumference of the mounting portion to mount the handle thereon.

14. The hose connection assembly for the vacuum cleaner of claim 2, wherein the mounting portion has a plurality of circumferential bead sections formed on the outer circumference of the mounting portion to mount the handle thereon.

* * * * *